US010920559B2

(12) United States Patent
Zahran

(10) Patent No.: US 10,920,559 B2
(45) Date of Patent: Feb. 16, 2021

(54) INVERTED Y-TOOL FOR DOWNHOLE GAS SEPARATION

(71) Applicant: Saudi Arabian Oil Company, Dhahran (SA)

(72) Inventor: Amr Mohamed Zahran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 7 days.

(21) Appl. No.: 16/460,539

(22) Filed: Jul. 2, 2019

(65) Prior Publication Data

US 2019/0323331 A1 Oct. 24, 2019

Related U.S. Application Data

(62) Division of application No. 15/427,658, filed on Feb. 8, 2017, now Pat. No. 10,385,672.

(51) Int. Cl.

| | |
|---|---|
| ***E21B 43/34*** | (2006.01) |
| ***E21B 43/12*** | (2006.01) |
| ***E21B 43/38*** | (2006.01) |
| ***E21B 43/08*** | (2006.01) |
| *E21B 33/12* | (2006.01) |

(52) U.S. Cl.

CPC ..... *E21B 43/34* (2013.01); *E21B 43/08* (2013.01); *E21B 43/128* (2013.01); *E21B 43/38* (2013.01); *E21B 33/12* (2013.01)

(58) Field of Classification Search

CPC ..... E21B 37/08; E21B 43/34; E21B 43/38; E21B 43/121; E21B 43/128

See application file for complete search history.

(56) References Cited

U.S. PATENT DOCUMENTS

| | | | |
|---|---|---|---|
| 3,735,815 | A | 5/1973 | Myers |
| 4,366,861 | A | 1/1983 | Milam |
| 4,531,228 | A | 7/1985 | Kazunori et al. |
| 5,271,725 | A | 12/1993 | Freet et al. |
| 5,389,128 | A | 2/1995 | Lopes |
| 5,431,228 | A | 7/1995 | Weingarten |
| 5,516,360 | A | 5/1996 | Normandeau et al. |
| 5,653,286 | A | 8/1997 | McCoy et al. |
| 5,902,378 | A | 5/1999 | Obrejanu |
| 6,079,491 | A | 6/2000 | Stuebinger et al. |
| 6,092,599 | A | 7/2000 | Berry et al. |

(Continued)

FOREIGN PATENT DOCUMENTS

| | | |
|---|---|---|
| CA | 2164145 | 11/1996 |
| GB | 2409691 | 2/2007 |
| WO | 2015167895 | 11/2015 |

OTHER PUBLICATIONS

Gulf Cooperation Council Examination Report issued in GCC Application No. GC2018-34727 dated Aug. 27, 2019, 5 pages.

(Continued)

*Primary Examiner* — Shane Bomar

(74) *Attorney, Agent, or Firm* — Fish & Richardson P.C.

(57) ABSTRACT

An inverted Y-tool is positioned in multiphase wellbore fluid flowing through a wellbore. The inverted Y-tool separates at least a portion of gas from the multiphase wellbore fluid and, after separating at least the portion of the gas from the multiphase wellbore fluid, directs the multiphase wellbore fluid to a downhole pump that pumps the wellbore fluid in an uphole direction.

8 Claims, 5 Drawing Sheets

(56) References Cited

U.S. PATENT DOCUMENTS

| | | | | |
|---|---|---|---|---|
| 6,092,600 | A | 7/2000 | McKinzie | |
| 6,131,660 | A | 10/2000 | Stuebinger et al. | |
| 6,155,345 | A | 12/2000 | Lee et al. | |
| 6,179,056 | B1 | 1/2001 | Smith | |
| 6,216,788 | B1 | 4/2001 | Wilson | |
| 6,179,054 | B1 | 10/2001 | Stewart | |
| 6,494,258 | B1 | 12/2002 | Weingarten | |
| 6,736,880 | B2 | 5/2004 | Ford et al. | |
| 6,945,762 | B2 | 9/2005 | Williams | |
| 8,475,147 | B2 | 7/2013 | Losinske | |
| 9,631,472 | B2 * | 4/2017 | Reid | E21B 43/128 |
| 2004/0238179 | A1 | 12/2004 | Murray | |
| 2005/0199551 | A1 * | 9/2005 | Gordon | B01D 63/00 210/650 |
| 2010/0147514 | A1 | 6/2010 | Swaringin | |
| 2011/0132593 | A1 | 6/2011 | Phloi-montri | |
| 2013/0068455 | A1 * | 3/2013 | Brown | E21B 43/128 166/265 |
| 2015/0233228 | A1 | 8/2015 | Roth et al. | |
| 2016/0222773 | A1 | 8/2016 | Sims | |
| 2017/0081952 | A1 * | 3/2017 | Osborne | B60R 9/048 |
| 2017/0328189 | A1 * | 11/2017 | Wang | E21B 43/128 |

OTHER PUBLICATIONS

International Search Report and Written Opinion issued in International Application No. PCT/US2018/015935 dated Apr. 26, 2018, 16 pages.

Don-Nan, "Gas Separator: Packer-style gas separator," don-nan.com, available on or before Apr. 10, 2012, retrieved on Sep. 7, 2018, retrieved from URL <https://irp-cdn.multiscreensite.com/4497d96c/files/uploaded/DN%20GS%20PS.pdf>, 1 page.

McCoy and Podio, "Improved Downhole Gas Separators," presented at the Southwester Petroleum Short Course, Department of Petroleum Engineering, Texas Tech University, Apr. 7-8, 1998, 11 pages.

McCoy et al., "Downhole Gas Separators,: A Laboratory and Field Study," Gas Well De-Liquification Workshop, Feb. 27-Mar. 1, 2006, 47 pages.

odessaseparator.com [online], "OSI: Fluid Condintioning Systems," available on or before Apr. 7, 2017, via Internet Archive: Wayback Machine URL: <https://web.archive.org/web/20170407235934/http://www.odessaseparator.com/products>, [retrieved on Sep. 7, 2018], retrieved from URL <https://www.odessaseparator.com/products>, 4 pages.

Gulf Cooperation Council Examination Report issued in GCC Application No. GC 2018-34727 dated Dec. 27, 2019, 3 pages.

* cited by examiner

INVERTED Y-TOOL FOR DOWNHOLE GAS SEPARATION

CROSS REFERENCE TO RELATED APPLICATIONS

This application is a Divisional of U.S. patent application Ser. No. 15/427,658, filed on Feb. 8, 2017, the entire contents of which is incorporated herein by reference.

TECHNICAL FIELD

This specification relates to downhole gas separation for oil and gas artificial lift production applications.

BACKGROUND

In hydrocarbon production, a wellbore is drilled into a hydrocarbon rich geologic formation. The wellbore is completed to create either a production or injection well. For a production well, the natural pressure of the hydrocarbon rich formation, often called a reservoir, may not be sufficient to produce the hydrocarbons. In such instances, artificial lift may be used to maintain or increase production rates. Artificial lift can include gas lift, downhole pumps, or any other form of artificial lift.

SUMMARY

This specification describes an inverted Y-tool downhole gas separator.

Certain aspects of this disclosure can be implemented as a downhole gas separation system. An inverted Y-tool is positioned in multiphase wellbore fluid flowing through a wellbore. The inverted Y-tool separates at least a portion of gas from the multiphase wellbore fluid and, after separating at least the portion of the gas from the multiphase wellbore fluid, directs the multiphase wellbore fluid to a downhole pump that pumps the wellbore fluid in an uphole direction.

The downhole pump can be at least one of an electric submersible pump, a rod pump, or a progressive cavity pump. The inverted Y-tool includes a first elongate tubular member with a first uphole end that attaches to a downhole end of the downhole pump. The pump can be positioned in the wellbore to pump the multiphase wellbore fluid in an uphole direction. A first downhole end can prevent flow of the multiphase wellbore fluid in a downhole direction. A second elongate tubular member fluidically connects to the first elongate tubular member. The second elongate tubular member can receive the multiphase wellbore fluid and can flow the received multiphase wellbore fluid in the downhole direction toward the first downhole end of the first elongate tubular member. The second elongate tubular includes a fluid inlet facing the uphole direction. The fluid inlet includes an opening that is substantially perpendicular to a flow path of the multiphase wellbore fluid flowing in the uphole direction. A filter can be attached to the second elongate tubular member. The filter can be positioned in a flow path of the multiphase wellbore fluid through the first elongate tubular member. the filter can filter particulates from the multiphase wellbore fluid. The filter can include a sand screen. The second elongate tubular member can separate gas from the multiphase wellbore fluid based on gravity. The second elongate tubular member can further include baffles positioned in a flow path of the multiphase wellbore fluid through the first elongate tubular member. The baffles can separate the gas from the multiphase wellbore fluid. The inverted Y-tool is can be installed in a deviated wellbore or a horizontal wellbore.

Certain aspects of this disclosure can be implemented as a method. The multiphase wellbore fluid is received at a fluid inlet facing an uphole direction. The multiphase wellbore fluid is drawn into the inlet in a downhole direction. At least a portion of the gas in the multiphase wellbore fluid rises in the uphole direction to separate from the multiphase wellbore fluid. The multiphase wellbore fluid from which at least the portion of the gas has separated is pumped in the uphole direction.

Drawing the multiphase wellbore fluid into the inlet in the downhole direction includes reversing a flow direction of the multiphase wellbore fluid from the uphole direction to the downhole direction. The fluid inlet is a fluid inlet of an elongate tubular member that includes a plurality of baffles disposed within. Gas drawn into the elongate tubular member is separated from the multiphase wellbore fluid in the elongate tubular member by the plurality of baffles. The multiphase wellbore fluid comprises at least one of water, crude-oil, or condensate. The multiphase wellbore fluid drawn into the inlet can be filtered to separate particulates from the multiphase wellbore fluid. The multiphase wellbore fluid can be filtered by a sand screen attached to the inlet. The filter can be cleaned by back flowing the multiphase wellbore fluid out of the inlet. The gas can include methane.

Certain aspects of this disclosure can be implemented as a downhole separation system. A downhole pump is positioned in a wellbore. The downhole pump fluidically connects to a production string in the wellbore. The downhole pump pumps multiphase wellbore fluid through the production string in an uphole direction. An inverted Y-tool is positioned in the wellbore. The inverted Y-tool fluidically connects to a downhole end of the downhole pump. The inverted Y-tool separates gas from the multiphase wellbore fluid before the multiphase wellbore fluid is received by the downhole pump. The inverted Y-tool includes a first elongate tubular member. The first elongate tubular member includes a first uphole end attached to a downhole end of the downhole pump that is positioned in the wellbore to pump the multiphase wellbore fluid in an uphole direction. A first downhole end, prevents flow of the multiphase wellbore fluid in a downhole direction. A second elongate tubular member fluidically connects to the first elongate tubular member. The second elongate tubular member receives the multiphase wellbore fluid and flows the received multiphase wellbore fluid in the downhole direction toward the first downhole end of the first elongate tubular member. The first tubular member further includes a plurality of internal baffles that can partially separate gas from the multiphase wellbore fluid.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
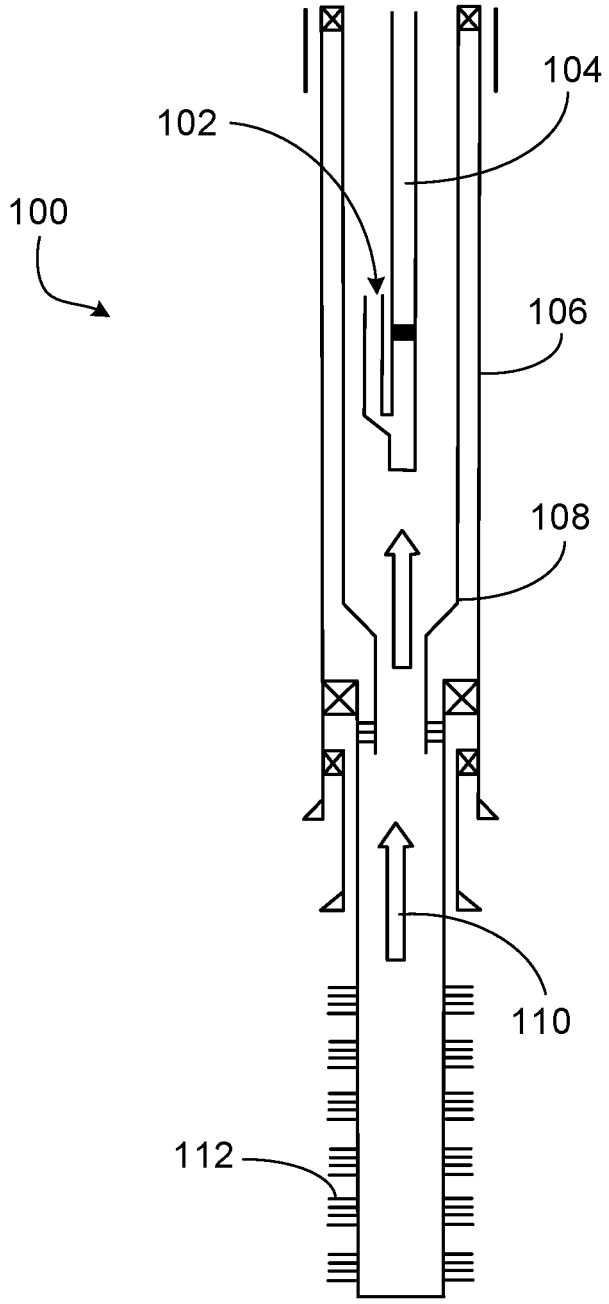
FIG. 1 is a schematic diagram of an example completed well with a downhole gas separation system installed.

As hydrocarbon production declines in a hydrocarbon production well, artificial lift can be used to increase and sustain the production. For example, artificial lift can be used for a producing oil well or a liquid rich gas well later in their production life. While there are several different types of artificial lift, one type includes using a downhole pump to decrease the bottomhole flowing pressure and pump the fluids up to a topside facility. Production fluid is sometimes a multiphase wellbore fluid carrying at least two or more of liquid, gas and solid. Free gas in the production fluid can affect the pump operation and lower the pump efficiency. Lower pump efficiency can lead to a reduced mean time between failures of the pump and more frequent workovers to replace the downhole pump. Excessive pump replacements can increase capital expenditures and reduce time producing the well. Over the lifetime of a well, such cost increases can be considerably high. In some instances, such production losses can affect reservoir integrity and change a long term plan for field development. Therefore, to maximize the ultimate recovery of a reservoir and ensure desired production rates are maintained, the presence of free gas within the production fluid should be considered.

One way to mitigate the effects of free gas in the production fluid is by setting the pump intake below a set of perforations. This is not always practical depending on the well construction. That is, there is often not enough space beneath the perforations to allow for sufficient separation. Another way to mitigate the effects of free gas in the production fluid is to install a downhole gas separator upstream of the downhole pump inlet.

An efficient way to separate gas from a multiphase wellbore fluid stream in a wellbore is discussed in this specification. An inverted Y-tool can be used to efficiently divert, that is, change a flow direction, of a multiphase wellbore fluid in a wellbore. The change in flow direction at least partially separates the gas from the multiphase wellbore fluid before the multiphase wellbore fluid enters the inlet of the downhole pump. The inverted Y-tool has a plugged bottom and a slim tubing that runs parallel to a main production tubing. The inverted Y-tool can be used for all types of downhole pumps, such as electric submersible pumps, rod pumps, positive cavity pumps, or any other types of downhole pump. The inverted Y-tool has no length limitation so long as it does not impact the end of the wellbore. The inverted Y-tool is very reliable as it has no moving parts and can be used with or without a packer. The inverted Y-tool is also re-usable and serviceable. The expected efficiency improvement can be calculated for each individual implementation based upon the fluid properties and the phase regime for the multiphase fluid. There can be significant separation efficiency increase using the inverted –Y-tool as it can act as a two-stage separator. In additions, the pump volumetric efficiency can increase as a result of improving the overall system efficiency. Such an improvement in efficiency can increase the mean-time-between failures for the pump since the pump runs closer to its best efficiency point when gas is at least partially removed from the multi-phase fluid stream. The two-stage separation system helps separate a portion of the gas in solution in addition to free gas as well. In some implementations the inverted Y-tool can also work as gas/sand separator. The inverted Y-tool can be utilized for all different types of downhole pumps and can work with or without packer.

FIG. 1 shows a completed well 100, which includes a casing string 108 positioned within a wellbore 106. A multiphase wellbore fluid 110 flows from perforations 112 into the wellbore 106. The multiphase wellbore fluid can include oil, condensate, water, gas, or any combination of fluids. The gas can be any hydrocarbon gas, such as methane. The multiphase wellbore fluid 110 flows in an uphole direction toward a production tubing 104. At a downhole end of the production tubing 104 is a downhole gas separation system 102, which helps efficiently move the multiphase wellbore fluid 110 through the production tubing 104 in an uphole direction towards a downhole pump intake that lifts the produced fluid s to a topside facility. That is, the multiphase wellbore fluid 110 must flow through the downhole gas separation system 102 as it is the only liquid flow path available for the multiphase wellbore fluid 110 to flow in the uphole direction. In some implementations, a packer may be positioned uphole of the gas separation system to force the multiphase wellbore fluid 110 into the downhole gas separation system 102, while in some implementations, a wellhead (not shown) can be used to force the multiphase wellbore fluid 110 into the downhole gas separation system 102. The downhole gas separation system 102 can be designed to produce minimal pressure drop and maintain flow efficiency.

Figure 2:
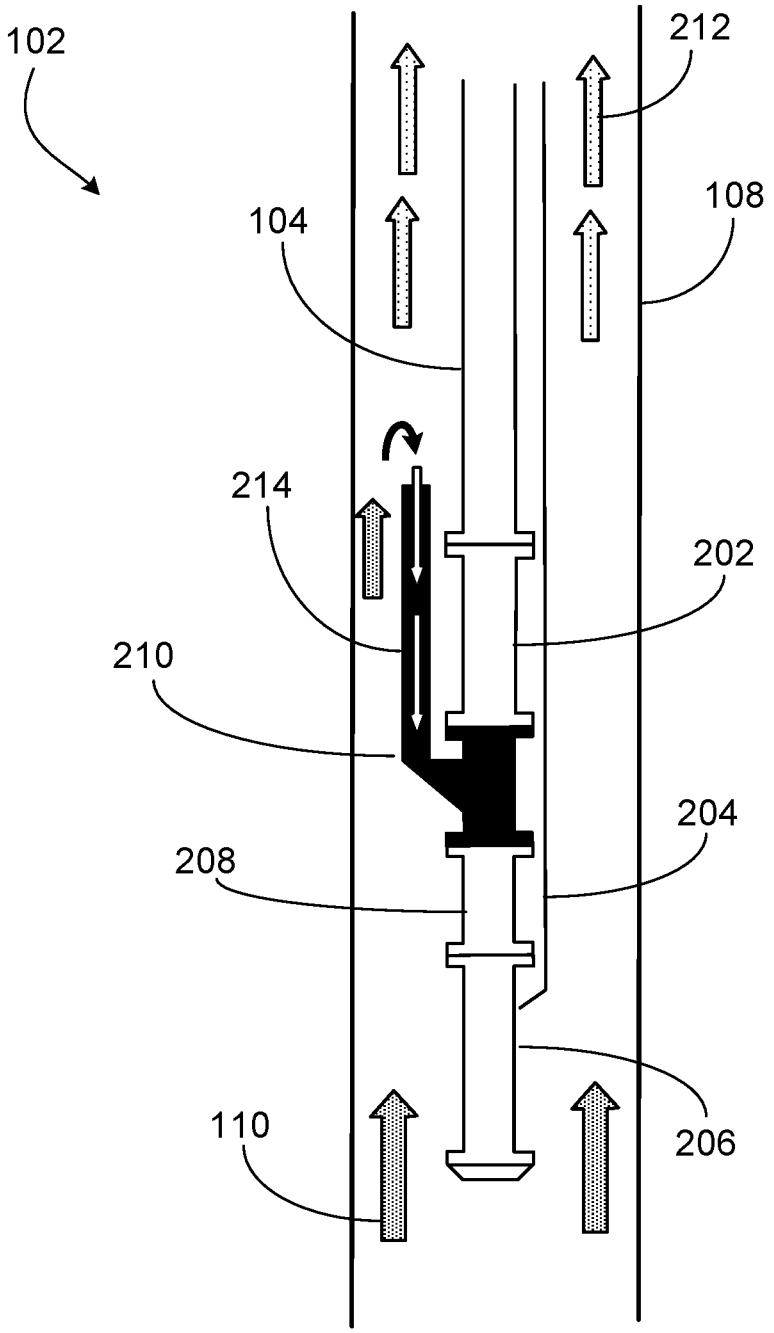
FIG. 2 is a schematic diagram of an example downhole gas separation system.

An example of the downhole gas separation system 102 is shown in greater detail in FIG. 2. The downhole gas separation system 102 includes an inverted Y-tool 210 that can be positioned in multiphase wellbore fluid 110 flowing through a wellbore 106. The inverted Y-tool 210 separates at least a portion of the gas from the multiphase wellbore fluid 110. Details on the separation process are described later. The downhole gas separation system 102 also includes a pump 202 and any necessary components for the pump 202. In the illustrated implementation, an electric submersible pump (ESP) is used. The ESP includes a motor 206 that is located at the downhole end of the downhole gas separation system 102, a seal 208 that is uphole of the motor 206 and prevents fluid ingress into the motor, and a pump 202 that imparts kinetic energy to a separated wellbore fluid to pump the separated wellbore fluid uphole through the production tubing 104 to a topside facility. For implementations where a motor, such as the motor 206, is used, a power cable 204 can supply power to the motor 206 from a topside facility (not shown). The inverted Y-tool 210 can be flanged or threaded to connect to the pump 202, the motor seal 208, or any other downhole pump component. In some implementations, a rod pump, a progressive cavity pump, or any other type of downhole pump can be used.

While the illustrated implementation shows a cased wellbore completion, the downhole gas separation system 102 can be used in the wellbore 106 with any type of completion; for example, an open hole completion or any other type of completion. The downhole gas separation system 102 can also be used in a horizontal well, a deviated well, a vertical well, or a well with any other orientation. Specifically, the inverted Y-tool 210 is parallel to the well trajectory, so it can be applied in any type of well with any orientation.

One way to mitigate the negative effects of gas flowing through the pump 202 is to separate out at least a portion of a free gas in the multiphase wellbore fluid 110 before the multiphase wellbore fluid 110 is ingested by the pump 202.

Any reduction in free gas within the multiphase wellbore fluid 110 will improve pump efficiency. The gas can be separated from the multiphase wellbore fluid by changing the flow direction of the multiphase wellbore fluid 110 and letting buoyancy effects assist in separation. In other words, temporarily flowing the multiphase wellbore fluid in a downhole direction allows heavier liquid components 214 to remain flowing downhole while the lighter gas 212 components continue to flow in the uphole direction. After separating at least a portion of the gas 212 from the multiphase wellbore fluid 110, the multiphase wellbore fluid 110 can be directed to the downhole pump 202 to flow the wellbore fluid liquid components 214 in an uphole direction towards the topside facility with minimal loss in pumping efficiency.

Figure 3:
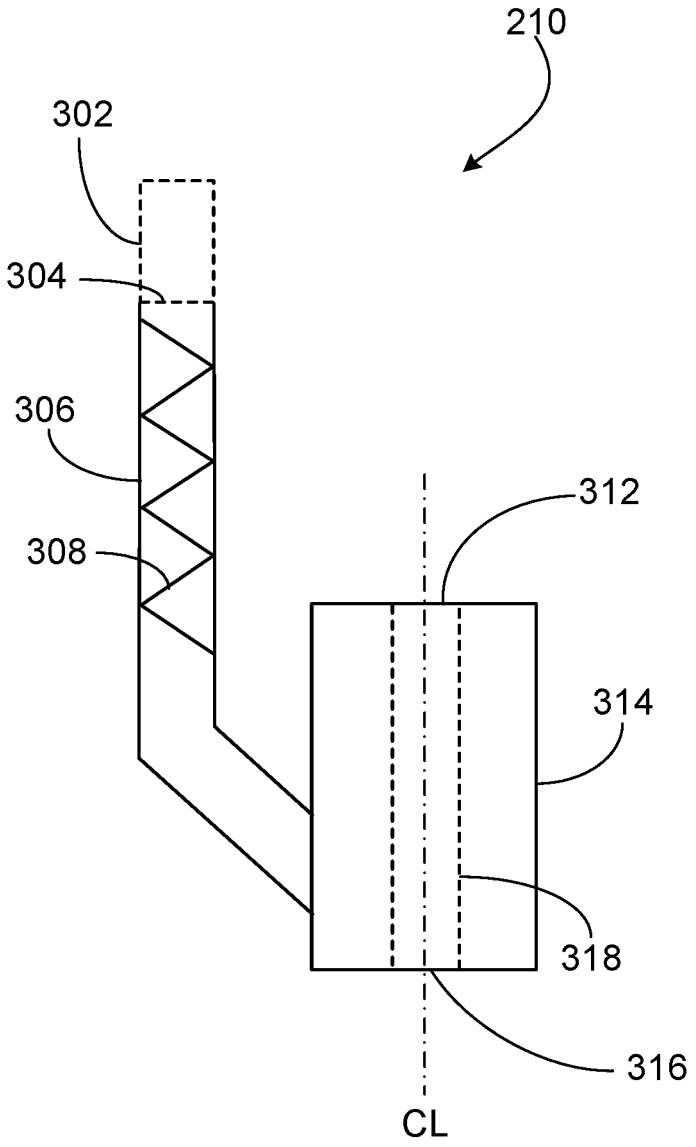
FIG. 3 is a schematic diagram of an example downhole gas separator.

FIG. 3 shows a detailed schematic of an example inverted Y-tool 210 that can be used in the downhole gas separation system 102. The inverted Y-tool 210 includes a first elongate tubular member 314. The uphole end 312 of the first elongate tubular member 314 can attach to a downhole end of the downhole pump 202 (not shown in FIG. 3). A first downhole end 316 of the first elongate tubular member 314 is blocked to prevent flow of the multiphase wellbore fluid 110 in the downhole direction. In some implementations, a pump shaft 318 can extend through the first elongate tubular member 314 to connect the pump 202 and the motor 206. The motor seal 208 prevents fluid ingress into the motor 206 in such an implementation. In the illustrated implementation, the shaft 318 is exposed to the multiphase wellbore fluid 110 and can be constructed out of a corrosion resistant material. The inverted Y-tool 210 also includes a second elongate tubular member 306 that is fluidically connected to a side of the first elongate tubular member 314 by a downhole end of the second elongate tubular member 306. The length of the second elongate tubular member 306 can be determined based on fluid properties and flow-regimes present in the wellbore 106. The length of the second elongate tubular member 306 is sufficient enough to allow at least partial separation of the gas 212 and liquid 214 phases of the multi-phase fluid 110. The second elongate tubular member 306 is substantially parallel to the first elongate tubular member 314 and the production tubing 104. In some implementations, the second elongate tubular member 306 may deviate from parallel, but such deviations are minor enough that the second tubular member 306 does not impact the well casing string 108 or the wellbore 106. The deviation from parallel can also occur so long as the multiphase wellbore fluid 110 is still diverted in a downhole direction in response to suction from the pump 202 to at least partially separate out any free gas 212 that may exist in the multiphase wellbore fluid 110. The second elongate tubular member 306 receives the multiphase wellbore fluid 110 from the completed well 100 and flows the received multiphase wellbore fluid 110 in the downhole direction toward and into the first elongate tubular member 314.

As previously described, a change of direction can partially separate the gas 212 from the multiphase wellbore fluid 110. In the illustrated implementation, the gas 212 is separated by the second elongate tubular member 306 based on buoyancy (gravity) forces and the change in direction caused by the second elongate tubular member 306. The second elongate tubular member 306 includes a fluid inlet 304 facing the uphole direction. The fluid inlet 304 opening is substantially perpendicular to the flow path of the multiphase wellbore fluid 110 flowing in the uphole direction. By "substantially perpendicular", it is meant that as the multiphase wellbore fluid 110 is traveling in the uphole direction, the multiphase wellbore fluid 110 changes direction to enter the fluid inlet 304 of the second elongate tubular member 306 allowing gas 212 in the multiphase wellbore fluid 110 to either continue flowing in the uphole direction or remain suspended in the fluid.

In some implementations, the second elongate tubular member 306 can include multiple baffles 308 positioned in a flow path of the multiphase wellbore fluid 110 through the second elongate tubular member 306. The baffles can at least partially separate the gas 212 from the multiphase wellbore fluid 110 and are installed at the uphole end 304 of the second elongate tubular member 306. The baffles 308 can be made-up of any type of angled baffle capable of breaking dissolved gas within the multiphase fluid 110 out into free gas 212.

In some implementations, a filter 302 can be attached to the fluid inlet 304 of the second elongate tubular member 306. The filter 302 is positioned in the flow path of the multiphase wellbore fluid 110 through the second elongate tubular member 306 and can filter out particulates from the multiphase wellbore fluid 110. Different types of filters can be used for filter 302, such as a sand screen or any other type of filter. The filter 302 is selected based on the particle size distribution for the expected multiphase fluid 110 and the capabilities of the downhole pump 202 to handle particulates. Particulates can be hazardous to both downhole and topside equipment. For example, sand particles can reduce the life of an ESP by causing erosion damage on the wetted surfaces of the ESP. In other words, the sand can impact the wetted surfaces of the ESP at a sufficient velocity to remove material from the wetted surface of the ESP. The filter 302 can prevent such damage from occurring by filtering out the potentially damaging particulates.

Figure 4:
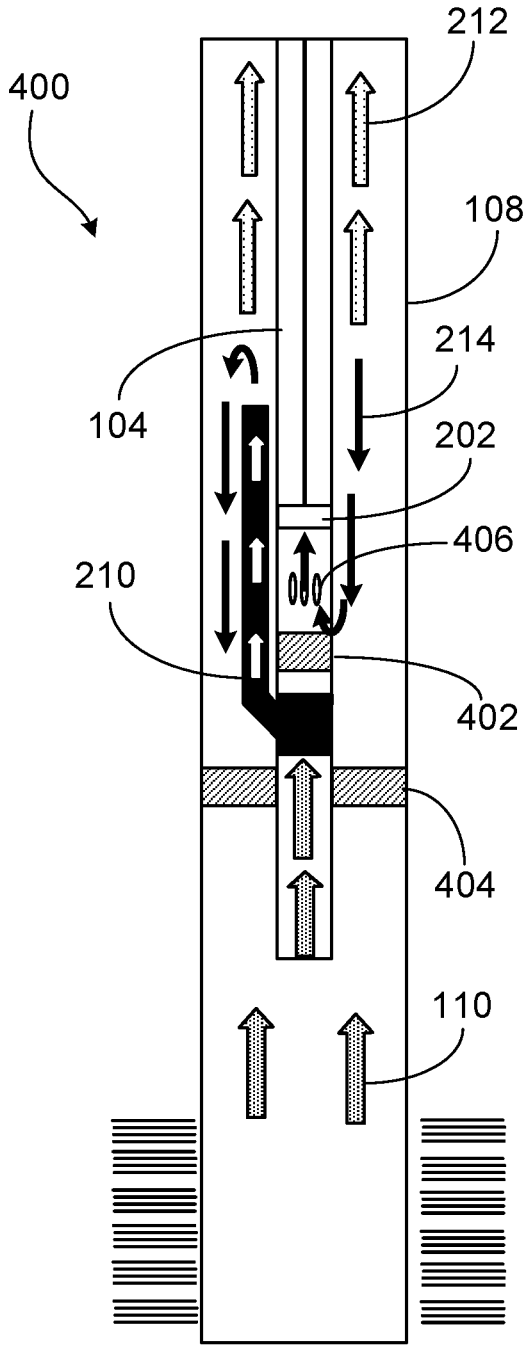
FIG. 4 is a schematic diagram of an alternative example downhole gas separation system.

FIG. 4 shows an alternative gas separation system 400. The alternative gas separation system 400 still includes an inverted Y-tool 210. The inverted Y-tool 210 in this implementation has an open first downhole end of a first elongate tubular member and a blocked uphole end 312 of the first elongate tubular member 314. The multiphase fluid 110 is forced into the downhole end 316 of the first tubular member 314 by a packer 404 that plugs the annulus uphole of the downhole end 316. The multiphase fluid 110 then flows into the second elongate tubular member 306 and out of a fluid outlet positioned on the uphole end 304 of the second elongate tubular member 306. The multiphase wellbore fluid 110 then changes direction to flow in a downhole direction towards a pump inlet 406. The heavier liquid components 214 flow in the downhole direction towards the pump inlet 406 while the lighter gas components 212 flow in an uphole direction. The pump in this implementation can be any downhole pump, such as an electric submersible pump, a push rod pump, or any other downhole pump.

Figure 5:
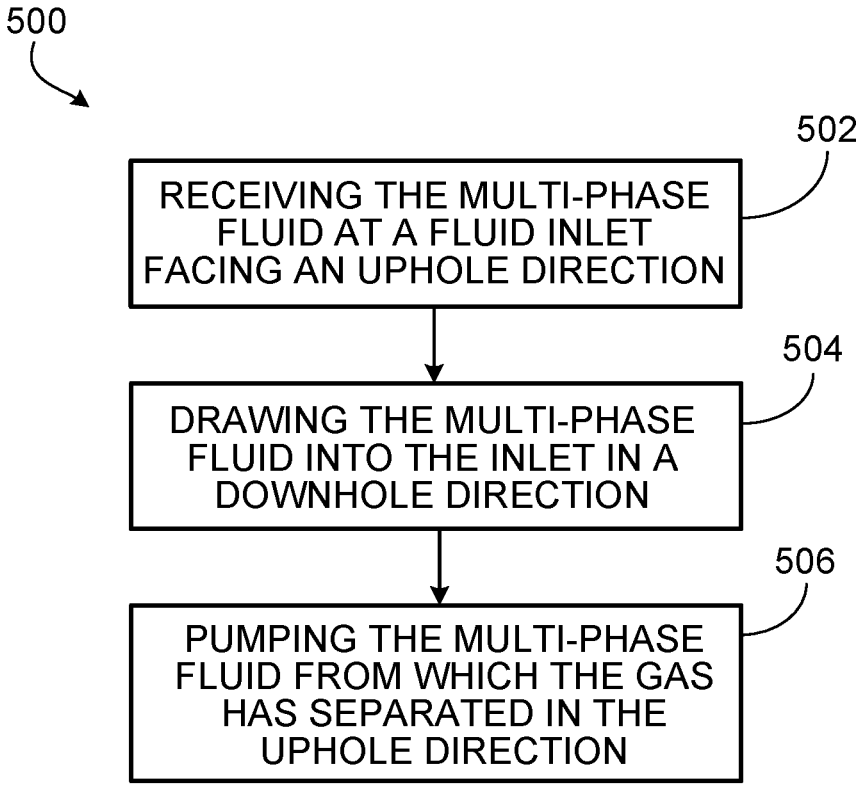
FIG. 5 is a flowchart showing an example method for separating fluids downhole.

FIG. 5 shows a flowchart with an example method 500 to separate gas from the multiphase wellbore fluid 110 in the wellbore 106. At 402, the multiphase wellbore fluid 110 is received at a fluid inlet 304 facing an uphole direction. At 404, the multiphase wellbore fluid 110 is drawn into the fluid inlet 304 in a downhole direction. At least a portion of the gas in the multiphase wellbore fluid 110 rises in the uphole direction to separate from the multiphase wellbore fluid 110. That is, a flow direction of the multiphase wellbore fluid 110 is reversed from the uphole direction to the downhole direction. In some implementations, multiple baffles 308 disposed within the second elongate tubular member 306 can partially separate gas drawn into the second elongate tubular member 306 from the multiphase wellbore fluid 110. In some implementations, the multiphase wellbore fluid is filtered by a sand screen 302 attached to the inlet. At 506, the multiphase wellbore fluid 110 from which at least the portion of the gas has separated is pumped in the uphole direction. In some instances, the filter 302 can be clogged by particulates. In such an instance, the filter 302 can be cleaned by back flowing the multiphase wellbore fluid 110 out of the fluid inlet 304 to the second elongate tubular member 306 by rotating the pump in the opposite direction, pumping a fluid, such as the multiphase wellbore fluid 110 in a downhole direction from a topside facility (not shown), or any other reverse flowing methods.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method to separate gas from a multiphase wellbore fluid in a wellbore, the method comprising:

receiving the multiphase wellbore fluid at a fluid inlet of an inverted Y-tool, the fluid inlet facing an uphole direction;

drawing the multiphase wellbore fluid into the inlet in a downhole direction;

during flow of the multiphase wellbore fluid through the inverted Y-tool in the downhole direction, separating at least a portion of gas from the multiphase wellbore fluid;

after separating at least the portion of the gas from the multiphase wellbore fluid, directing the multiphase wellbore fluid through the inverted Y-tool in the uphole direction to a downhole pump; and pumping, by the downhole pump, the multiphase wellbore fluid from which at least the portion of the gas has separated in the uphole direction.

2. The method of claim 1, wherein drawing the multiphase wellbore fluid into the inlet in the downhole direction comprises reversing a flow direction of the multiphase wellbore fluid from the uphole direction to the downhole direction.

3. The method of claim 1, wherein the fluid inlet is a fluid inlet of an elongate tubular member comprising a plurality of baffles disposed within, and wherein the method further comprises separating, by the plurality of baffles, gas drawn into the elongate tubular member from the multiphase wellbore fluid in the elongate tubular member.

4. The method of claim 1, wherein the multiphase wellbore fluid comprises at least one of water, crude-oil, or condensate.

5. The method of claim 1, further comprising filtering the multiphase wellbore fluid drawn into the inlet to separate particulates from the multiphase wellbore fluid.

6. The method of claim 5, further comprising filtering the multiphase wellbore fluid by a sand screen attached to the inlet.

7. The method of claim 6, further comprising cleaning the filter by back flowing the multiphase wellbore fluid out of the inlet.

8. The method of claim 1, wherein the gas comprises methane.

* * * * *